US009019047B2

(12) United States Patent
Kozakowski et al.

(10) Patent No.: US 9,019,047 B2
(45) Date of Patent: Apr. 28, 2015

(54) WAVEGUIDE E-PLANE FILTER STRUCTURE WITH CONTROLLABLE SIZE

(75) Inventors: Piotr Kozakowski, Göteborg (SE); Anatoli Deleniv, Mölndal (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 14/113,372

(22) PCT Filed: May 18, 2011

(86) PCT No.: PCT/EP2011/058047
§ 371 (c)(1),
(2), (4) Date: Oct. 22, 2013

(87) PCT Pub. No.: WO2012/155969
PCT Pub. Date: Nov. 22, 2012

(65) Prior Publication Data

US 2014/0049342 A1 Feb. 20, 2014

(51) Int. Cl.

| | |
|---|---|
| ***H01P 1/20*** | (2006.01) |
| ***H01P 1/201*** | (2006.01) |
| ***H01P 1/207*** | (2006.01) |
| ***H01P 1/213*** | (2006.01) |

(52) U.S. Cl.
CPC ..... *H01P 1/20* (2013.01); *H01P 1/2016* (2013.01); *H01P 1/207* (2013.01); *H01P 1/2138* (2013.01)

(58) Field of Classification Search
USPC ..... 333/208, 212
See application file for complete search history.

(56) References Cited

U.S. PATENT DOCUMENTS 6,876,277 B2 * 4/2005 Cooper ..... 333/208

OTHER PUBLICATIONS

Goussetis, G., et al., "A 3rd Order Ridge Waveguide Filter with Parallel Coupled Resonators." IEEE 2004 Microwave Symposium Digest, vol. 2, Jun. 6, 2004, pp. 595-597. IEEE, Piscataway, NJ.
Lopez-Villarroya, R., et al. "E-plane Filters with Selectively Located Transmission Zeros." Proceedings of the IEEE 38th European Microwave Conference (EUMC 2008). Oct. 27, 2008, pp. 733-736. IEEE, Piscataway, NJ.

(Continued)

*Primary Examiner* — Daniel Rojas
(74) *Attorney, Agent, or Firm* — Coats & Bennett, PLLC

(57) ABSTRACT

The present invention relates to a waveguide E-plane filter component (1) comprising a first and second main part (2: 4) with a corresponding first and second waveguide section part (3, 5). The main parts (2, 4) are arranged to be mounted to each other, such that an open side (8) of the first waveguide section part (3) is arranged to face an open side (9) of the second waveguide section part (5). The E-plane filter component (1) further comprises at least one electrically conducting foil (10, 11) that is arranged to be placed between the main part (2, 4), Said foil (10, 11) have a longitudinal extension (L) and comprises a filter part (12) that is arranged to run between the waveguide section parts (3, 5), and is divided into a first filter part (13) and a second filter part (14) by an imaginary symmetry line (15) running along the longitudinal extension (L) in the middle of the filter part (12). The filter part (12) comprises at least a first aperture (16*a*) and a second aperture (16*b*), where the major part of the first aperture (16*a*) is positioned in the first filter part (13) and the major part of the second aperture (16*b*) is positioned in the second filter part (14). All parts of the apertures are separated along the longitudinal extension (L).

14 Claims, 4 Drawing Sheets

(56) References Cited

OTHER PUBLICATIONS

Vahldieck, R., et al. "Computer-Aided Design of Parallel-Connected Millimeter-Wave Diplexers/Multiplexers." 1988 IEEE MTT-S Digest, pp. 435-438. May 25, 1988. IEEE, Piscataway, NJ.

Tudosie, G., et al. "Hybrid EM-Simulator Based Optimization of Microwave and Millimeter Wave Diplexers and Multiplexers." IEEE 2003 International Microwave Symposium Digest (IMS 2003). vol. 2, Jun. 8, 2003, pp. 1219-1222. IEEE, Piscataway, NJ.

* cited by examiner

WAVEGUIDE E-PLANE FILTER STRUCTURE WITH CONTROLLABLE SIZE

TECHNICAL FIELD

The present invention relates to a waveguide E-plane filter component which comprises a first main part, which in turn comprises a first waveguide section part, and a second main part, which in turn comprises a second waveguide section part. The main parts are arranged to be mounted to each other, each waveguide section part comprising a bottom wall, corresponding side walls and an open side. The open side of the first waveguide section part is arranged to face the open side of the second waveguide section part. The waveguide E-plane filter component further comprises at least one electrically conducting foil that is arranged to be placed between the first main part and the second main part when the main parts are mounted to each other. The foil has a longitudinal extension and comprises a filter part that is arranged to run between the waveguide section parts. The filter part is divided into a first filter part and a second filter part by an imaginary symmetry line running along the longitudinal extension in the middle of the filter part. The filter part comprises at least a first aperture and a second aperture in said foil.

BACKGROUND

Waveguide filters and diplexers constitute an essential part of modern communication systems. Despite impressive progress in the last few decades in the microwave technology, the important role of waveguide components remains undisputed. This is due to their low loss and high power capability performance.

In order to secure commercial success, the waveguide filters and diplexers need to be not only optimally designed in terms of performance, but also in terms of cost. E-plane filter technology with an electrically conductive foil is one of the most suitable technologies for mass production due to low cost involved.

A waveguide E-plane filter component normally comprises two main parts, a first main part comprising a first waveguide section part and a second main part comprising a second waveguide section part. Each waveguide section part comprises three walls; a bottom and corresponding sides.

The first main part and the second main part are arranged to be mounted together such that the first waveguide section part and the second waveguide section part face each other, and together constitute a resulting waveguide section part. This means that each main part comprises a half-width waveguide section part where, when mounted together, the resulting waveguide section part constitutes a full-width waveguide section part.

The electromagnetic field propagates parallel to the intersection. Since the waveguide section parts normally have equal sizes, and thus the same width of the corresponding sides, the dominant $TE_{10}$ mode of the electromagnetic field has its maximum magnitude at said intersection.

Between the main parts, at the intersection, an electrically conducting foil is placed, having a filter part comprising full height or partial-height apertures. The filter part runs between the waveguide section parts.

The main advantage using E-plane filters is that in many cases the same main parts can be used for filters working at different center frequencies and/or covering different bandwidths. Then, since a filter function is determined by a topology of the electrically conducting foil, it is only the foil which needs to be replaced whenever a change in the filter characteristic is required However, using E-plane technology results in filters/diplexers which are of a relatively large size. The size of an E-plane filer/diplexer, especially the longitudinal length of the electrically conducting foil, is defined by a desired filter performance; center frequency and bandwidth. This means that, to a large extent, the size of the main parts is determined by the longitudinal length of the electrically conducting foil.

This poses a problem since it brings inflexibility where instead flexibility may be required. For example, when a diplexer design is concerned, the distance between a so-called band-stop resonator in the form of a T-junction and a common port of the diplexer needs to be fixed. If the required longitudinal length of the electrically conducting foil which is placed between the band-stop resonator and the common port exceeds said fixed length some functionality may have to be degraded.

This can limit the possibility of having the same housing and different electrically conductive foils inserted between the main parts in order to realize different filter/diplexer characteristics.

There is thus a need for being able to vary the length of the electrically conductive foil in a controlled manner while keeping the same filter response, such that both flexibility and control are achieved for designing E-plane filters.

SUMMARY

The object of the present invention is to present a microwave waveguide E-plane filter component comprising an electrically conductive foil insert, where the length of the electrically conductive foil can be varied in a controlled manner while keeping the same filter response.

Said object is achieved by means of a microwave waveguide E-plane filter component which comprises a first main part, which in turn comprises a first waveguide section part, and a second main part, which in turn comprises a second waveguide section part. The main parts are arranged to be mounted to each other, each waveguide section part comprising a bottom wall, corresponding side walls and an open side. The open side of the first waveguide section part is arranged to face the open side of the second waveguide section part. The waveguide E-plane filter component further comprises at least one electrically conducting foil that is arranged to be placed between the first main part and the second main part when the main parts are mounted to each other. The foil has a longitudinal extension and comprises a filter part that is arranged to run between the waveguide section parts. The filter part is divided into a first filter part and a second filter part by an imaginary symmetry line running along the longitudinal extension in the middle of the filter part. The filter part comprises at least a first aperture and a second aperture in said foil. The major part of the first aperture is positioned in the first filter part and that the major part of the second aperture is positioned in the second filter part, all parts of the apertures being separated along the longitudinal extension.

According to an example, the first aperture is positioned only in the first filter part and that second aperture is positioned only in the second filter part.

According to another example, the first aperture comprises a first aperture second edge and the second aperture comprises a second aperture first edge. These edges each have a corresponding first imaginary extension and second imaginary extension running along the edges. The extensions face each other and are separated by a first distance.

According to another example, the filter part further comprises a third aperture and a fourth aperture in said foil. The major part of the third aperture is positioned in the first filter part and the major part of the fourth aperture is positioned in the second filter part, where all parts of the apertures are separated along the longitudinal extension.

Preferably, the second aperture comprises a second aperture second edge, the third aperture comprises a third aperture first edge and a third aperture second edge, and the fourth aperture comprises a fourth aperture first edge. These edges have a corresponding third imaginary extension, fourth imaginary extension, fifth imaginary extension and sixth imaginary extension running along the corresponding edges. The third extension and the fourth extension face each other and are separated by a second distance, and the fifth extension and the sixth extension face each other and are separated by a third distance.

Other examples are evident from the dependent claims.

A number of advantages are obtained by means of the present invention, for example

- Only one type of main parts has to be made for a certain frequency band, leading to lower productions costs and easier logistic handling due to fewer different types of main parts.
- A less expensive versatile filter arrangement is obtained.
- Different types of foils are easily manufactured, stored and handled.
- The length of the electrically conductive foils may be reduced and controlled.

BRIEF DESCRIPTION OF THE DRAWINGS

The present invention will now be described more in detail with reference to the appended drawings, where.

DETAILED DESCRIPTION

Figure 1:
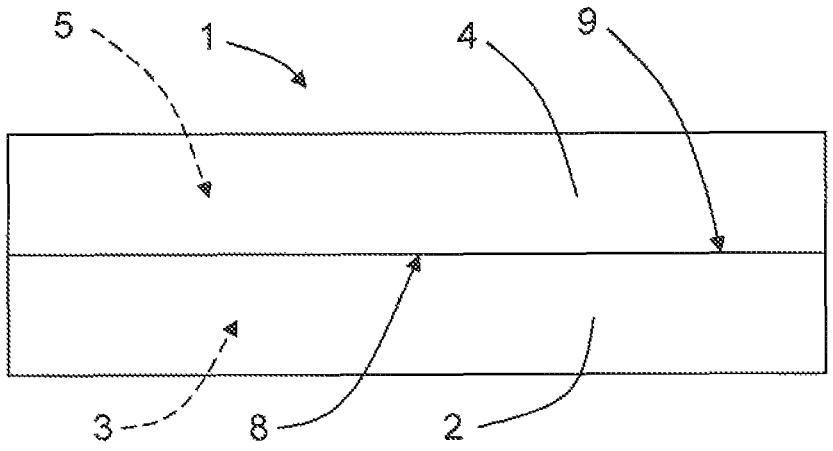
FIG. 1 shows a diplexer comprising a first main part and a second main part.
Figure 2:
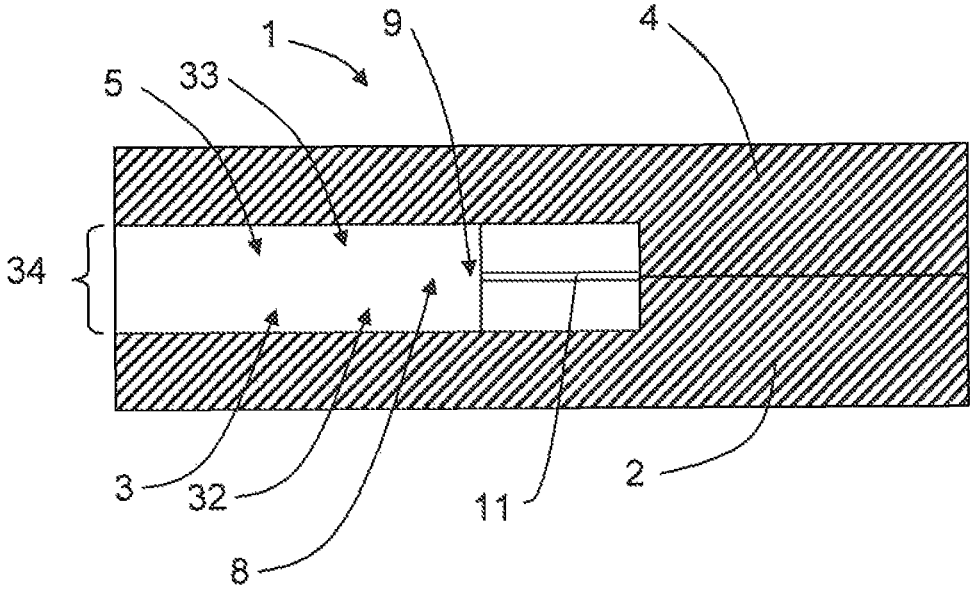
FIG. 2 shows a cross-section of FIG. 1.

With reference to FIG. 1 and FIG. 2, FIG. 2 showing a section of FIG. 1, a waveguide E-plane filter diplexer 1 comprises a first main part 2, which in turn comprises a first waveguide section part 3, and a second main part 4, which in turn comprises a second waveguide section part 5. The first waveguide section part 3 and the second waveguide section part 5 are only indicated schematically in FIG. 1, and the first waveguide section part 3 will be described more in detail in the following, the second waveguide section part 5 being similar.

As shown in FIG. 1 and FIG. 2, the main parts 2, 4 are arranged to be mounted to each other, the waveguide section parts 3, 5 thus facing each other.

Figure 3:
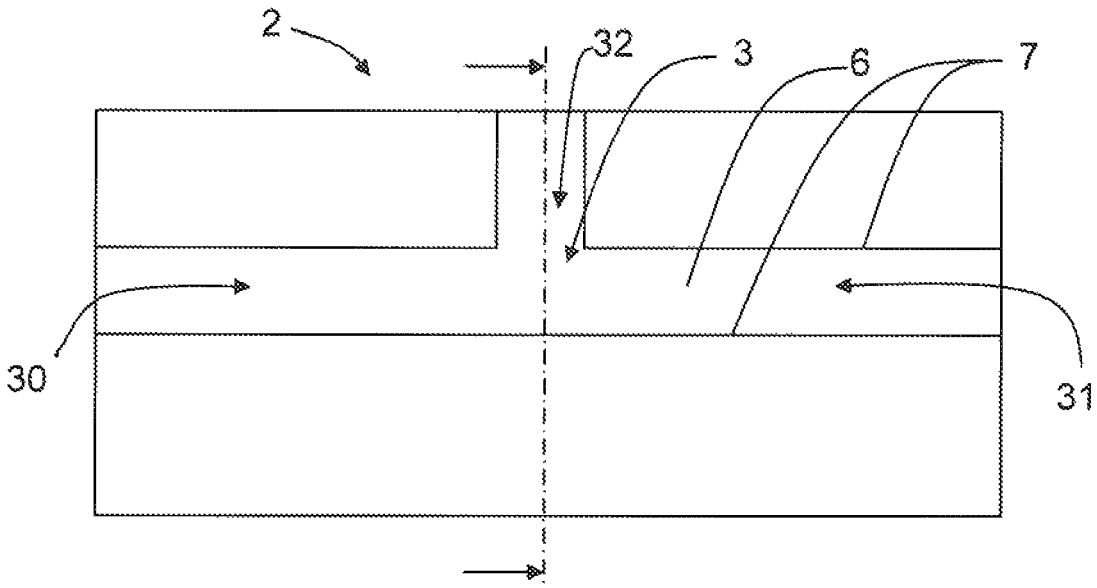
FIG. 3 shows a first main part.
Figure 4:
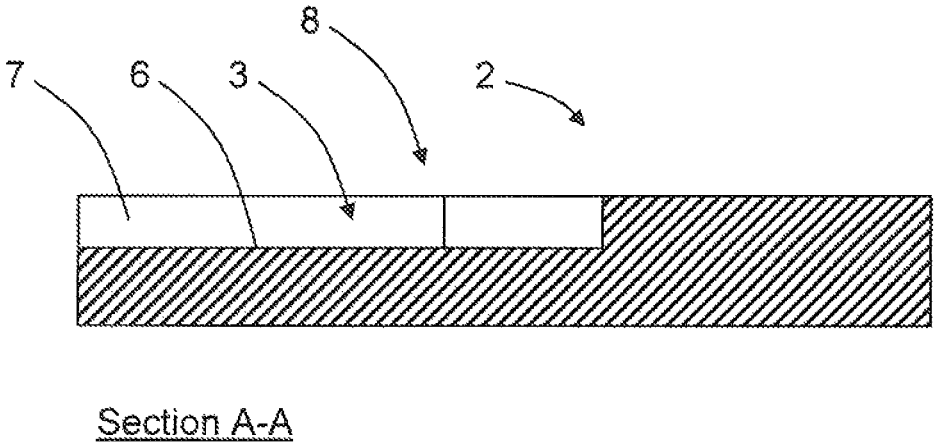
FIG. 4 shows a cross-section of FIG. 3.

With reference to FIG. 3 and FIG. 4, FIG. 4 showing a section of FIG. 3, the first main part 2 will now be described more in detail, and it is to be understood that the second main part 4 has a corresponding appearance. The waveguide section part 3 comprises a bottom wall 6, corresponding side walls 7 and an open side 8, where the open side 8 of the first waveguide section part 3 is arranged to face an open side 9 of the second waveguide section part 5, schematically indicated in FIG. 1 and FIG. 2.

The waveguide section part 3 further comprises a first branch 30 and a second branch 31, these branches 30, 31 being combined with a third branch 32. Corresponding branches constitute the second waveguide section part 5, a corresponding third branch 33 is shown in FIG. 2. When the first main part 2 and the second main part 4 are mounted, these branches face each other such that corresponding combined branches are formed, as being schematically indicated by the reference number 34 in FIG. 2.

Figure 5:
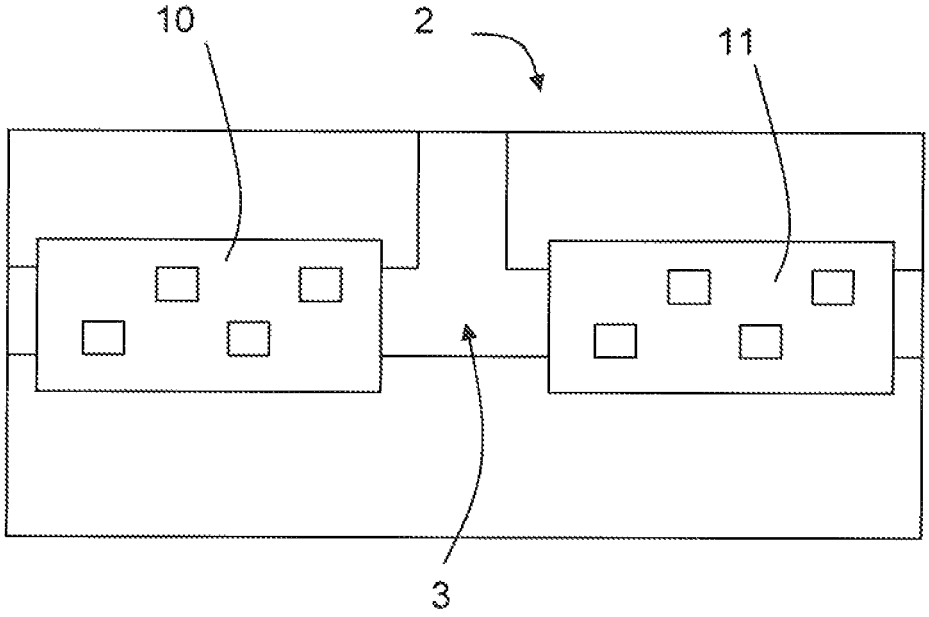
FIG. 5 shows a the first main part with electrically conducting foils.

With reference to FIG. 5, for reasons of clarity only showing the first main part 2, the diplexer 1 further comprises a first electrically conducting foil 10 for the first branch 30 and a second electrically conducting foil 11 for the second branch 31, the electrically conducting foils 10, 11 being arranged to be placed between the first main part 2 and the second main part 4 when the main parts 2, 4 are mounted to each other as shown in FIG. 2, showing the second electrically conducting foil 11 in its position.

Figure 6:
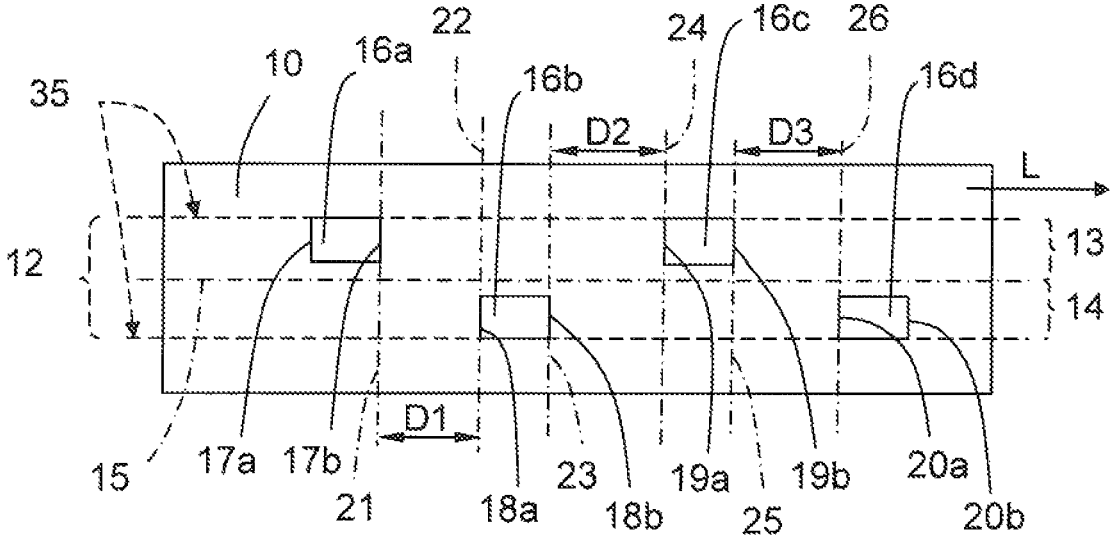
FIG. 6 shows a first type of electrically conducting foil.

With reference also to FIG. 6, showing the first electrically conducting foil 10, the first electrically conducting foil 10 has a longitudinal extension L and comprises a filter part 12 that is arranged to run between the waveguide section parts 3, 5.

The filter part 12 is indicated with dashed lines 35, the dashed lines 35 being intended to follow the side walls 7 when the first electrically conducting foil 10 is mounted to the first main part 2 such that the filter part 12 follows the side walls 7. The filter part 12 is furthermore divided into a first filter part 13 and a second filter part 14 by an imaginary symmetry line 15 running along the longitudinal extension L in the middle of the filter part 12. When the first main part 2 and the second main part 4 are mounted, as shown in FIG. 2, the filter part 12 will also follow the side walls of the second waveguide section part 5 in a corresponding manner.

The first electrically conducting foil 10 comprises a first aperture 16*a*, a second aperture 16*b*, a third aperture 16*c*, and a fourth aperture 16*d*, and as apparent from FIG. 5, the second electrically conducting foil 11 comprises corresponding apertures.

According to the present invention, the major part of the first aperture 16*a* is positioned in the first filter part 13 and that the major part of the second aperture 16*b* is positioned in the second filter part 14. Furthermore, the major part of the third aperture 16*c* is positioned in the first filter part 13 and the major part of the fourth aperture 16*d* is positioned in the second filter part 14.

All parts of the apertures 16*a*, 16*b*, 16*c*, 16*d* are separated along the longitudinal extension L, thus none of the apertures 16*a*, 16*b*, 16*c*, 16*d* being overlapping in the longitudinal extension L.

In this example, the first aperture 16*a* has a first aperture first edge 17*a* and a first aperture second edge 17*b*, the edges 17*a*, 17*b* being mutually parallel and running across the longitudinal extension L, thus being perpendicular to the longitudinal extension L. The edges 17, 17*b* define a width of the first aperture 16*a*, and their separation defines a length of the first aperture 16*a*, the first aperture 16*a* having a rectangular appearance.

In the same way, the second aperture 16*b* comprises a second aperture first edge 18*a* and a second aperture second edge 18*b*; the third aperture 16*c* comprises a third aperture first edge 19*a* and a third aperture second edge 19*b*; and the fourth aperture 16*d* comprises a fourth aperture first edge 20*a* and a fourth aperture second edge 20*b*.

A first imaginary extension 21 of the first aperture second edge 17*b* and a second imaginary extension 22 of the second aperture first edge 18*a* are separated by a first distance D1, the first imaginary extension 21 and the second imaginary extension 22 facing each other. Furthermore, a third imaginary extension 23 of the second aperture second edge 18*b* and a fourth imaginary extension 24 of the third aperture first edge 19*a* are separated by a second distance D2, the third imaginary extension 23 and the fourth imaginary extension 24 facing each other. Furthermore, a fifth imaginary extension 25 of the third aperture second edge 19*b* and a sixth imaginary extension 26 of the fourth aperture first edge 20*a* are separated by a third distance D3, the fifth imaginary extension 25 and the sixth imaginary extension 26 facing each other.

This means that, in accordance with the present invention, all apertures 16*a*, 16*b*, 16*c*, 16*d* are positioned one after the other in an alternating manner along the imaginary symmetry line 15, where two adjacent aperture sides are separated in the longitudinal extension L by one of said distances D1, D2, D3. By means of the present invention, the distances D1, D2, D3 may be reduced and controlled.

In this example, the first aperture 16*a* and the third aperture 16*c* are only positioned in the first filter part 13, and the second aperture 16*b* and the fourth aperture 16*d* are only positioned in the second filter part 14.

Alternatively, as shown in FIG. 2, showing a second example of an electrically conducting foil 10', the electrically conducting foil 10 comprises a first aperture 16*a*', a second aperture 16*b*' a third aperture 27*a* and a fourth aperture 27*b*. The first aperture 16*a*' has a first aperture first edge 17*a*' and a first aperture second edge 17*b*', and the second aperture has a second aperture first edge 18*a*' and a second aperture second edge 18*b*' in the same way as disclosed for the first aperture and the second aperture in the previous example.

The first aperture second edge 17*b* and the second aperture first edge 18*a*', have a corresponding first imaginary extension 21' and second imaginary extension 22' running along the edges 17*b*, 18*a*', the extensions 21', 22' facing each other and being separated by a first distance D1'.

In this example, the first aperture 16*a*' is positioned both in the first filter part 13 and in the second filter part 14, but the major part of the first aperture 16*a*' is positioned in the first filter part 13. In the same way, the second aperture 16*b*' is positioned both in the second filter part 14 and in the first filter part 13, but the major part of the second aperture 16*b*' is positioned in the second filter part 14. The first aperture 16*a* and the second aperture 16*b*' are thus still positioned in an alternating non-overlapping manner along the imaginary symmetry line 15, which is an essential feature of the present invention.

The third aperture 27*a* and the fourth aperture 27*b* extend over both filter parts 13, 14, symmetrically along the imaginary symmetry line 15, for example across the whole filter part 12. These apertures 27*a*, 27*b* are thus of a prior art style, illustrating that it is possible to mix the apertures of the present invention with prior art apertures in one and the same electrically conducting foil 10, where at least two adjacent apertures 16*a*', 16*b*' should be arranged according to the present invention.

This means that the first aperture 16*a*' and the second aperture 16*b*' are positioned one after the other in an alternating manner along the imaginary symmetry line 15, while the third aperture 27*a* and the fourth aperture 27*b* are positioned one after the other in a symmetrical manner along the imaginary symmetry line 15.

Figure 7:
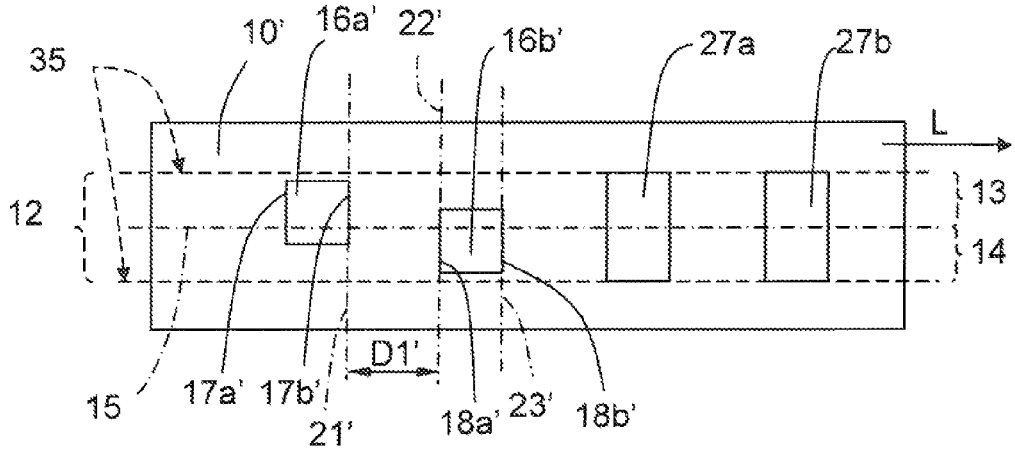
FIG. 7 shows a second type of electrically conducting foil.

This alternating positioning of the non-overlapping apertures along the symmetry line 15 which has been disclosed above enables the distances between the apertures to be reduced compared with prior art aperture arrangements, such as the third aperture 27*a* and the fourth aperture 27*b* in FIG. 7. This leads to reduced size of the electrically conducting foils and thus reduced size of the E-plane filter component where such a foil is used.

Figure 8:
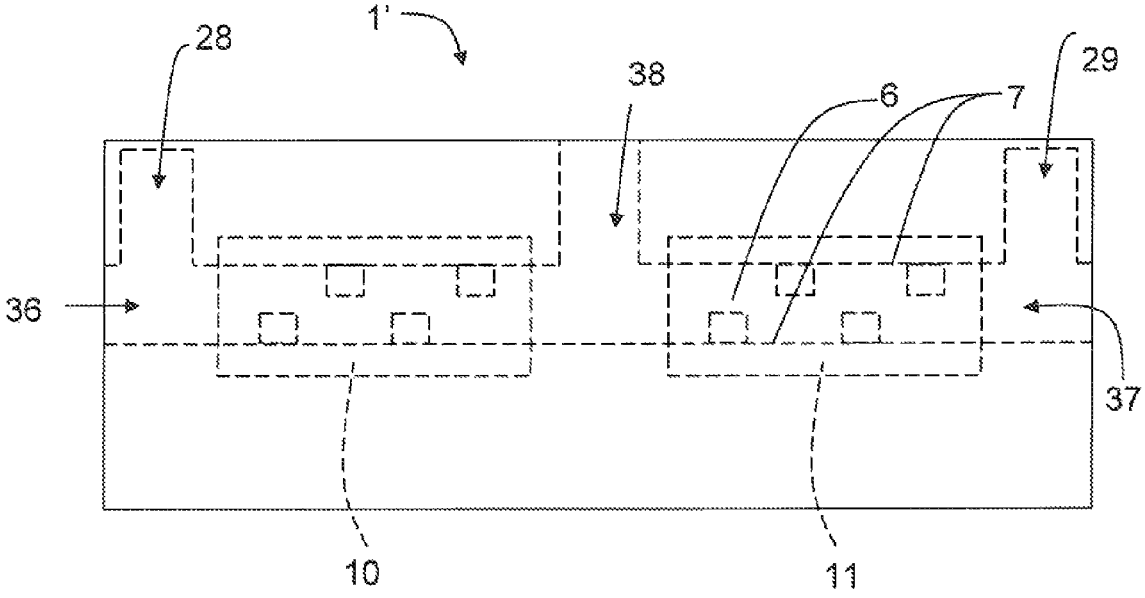
FIG. 8 shows a top view of a diplexer with band-stop resonators and electrically conducting foils.

In another example with reference to FIG. 8, the present invention is used in a filter comprising band-stop resonators, where the alternating arrangement of the apertures is shown also to provide control of the design of an E-plane filter. An E-plane filter 1' is shown having a first branch 36 and a second branch 37, these branches 36, 37 being combined with a third branch 38. Between two corresponding main parts, a first electrically conducting foil 10 and a second electrically conducting foil 11 is inserted as described previously.

In this example, the E-plane filter 1 comprises a first band-stop resonator 28 and a second band-stop resonator 29, the first band-stop resonator 28 being positioned in the first branch 36 and the second band-stop resonator 29 being positioned in the second branch 37. The first electrically conducting foil 10 is placed between the first band-stop resonator 28 and the third branch 38, and the second electrically conducting foil 11 is placed between the second band-stop resonator 29 and the third branch 38.

By means of the present invention, the total length of the electrically conducting foils 10, 11 can be controlled, such that the positioning of the band-stop resonators 28, 29 may be designed independently of the electrically conducting foils 10, 11. Thus the electrically conducting foils 10, 11 may be adapted to the final design of the main parts of the E-plane filter 1.

The electrically conducting foils 10, 11 may for example be designed by controlling how much part of the alternating apertures, if any that should pass over the imaginary symmetry line by controlling the width and position of the apertures, and by controlling a possible insertion of prior art apertures 27*a*, 27*b*.

The present invention is not limited to the examples above, but may vary freely within the scope of the appended claims. For example, the diplexer shown is only one example of a waveguide E-plane filter component that is suitable for the present invention. Other types are easily conceivable for the skilled person, and may for example be single filters, having only one branch, or triplexers.

Each electrically conducting foil 10, 11 may have any number and shape of apertures.

The apertures are shown as rectangular in the examples discussed, but may have any suitable shape such as elliptical or triangular.

In a general case, for two adjacent apertures, the corresponding imaginary extensions facing each other pass through those parts of said apertures that lie closest to each other, the distance between said imaginary extensions constituting the closest distance between these apertures in the longitudinal extension L. For all examples, there is always such a distance, which means that all apertures are positioned one after the other in a non-overlapping manner in the longitudinal extension L.

The conducting foil 10, 11 may be made in any suitable material such as copper, gold or aluminium.

The main parts 2, 4 may be made in any suitable material such as aluminium or plastics covered with an electrically conducting layer.

What is claimed is:

1. A waveguide E-plane filter component, comprising:
a first main part which in turn comprises:
a first waveguide section part and a second main part which in turn comprises a second waveguide section part, the main parts being arranged to be mounted to each other, each waveguide section part comprising:
a bottom wall, corresponding side walls and an open side, where the open side of the first waveguide section part is arranged to face the open side of the second waveguide section part, where the waveguide E-plane filter component further comprises:
at least one electrically conducting foil that is arranged to be placed between the first main part and the second main part when the main parts are mounted to each other, said foil having a longitudinal extension and comprising:
a filter part that is arranged to run between the waveguide section parts, the filter part being divided into a first filter part and a second filter part by an imaginary symmetry line running along the longitudinal extension in the middle of the filter part, the filter part at least comprising:
a first aperture and a second aperture in said foil, a major part of the first aperture is positioned in the first filter part and that the major part of the second aperture is positioned in the second filter part, all parts of the apertures being separated along the imaginary symmetry line.

2. The waveguide E-plane filter component according to claim 1, wherein the first aperture is positioned only in the first filter part and that the second aperture is positioned only in the second filter part.

3. The waveguide E-plane filter component according to claim 1, wherein the first aperture comprises a first aperture second edge and the second aperture comprises a second aperture first edge, where said edges have a corresponding first imaginary extension and second imaginary extension running along the edges, the extensions facing each other and being separated by a first distance.

4. The waveguide E-plane filter component according to claim 1, wherein the filter part further comprises a third aperture and a fourth aperture in said foil, where a major part of the third aperture is positioned in the first filter part and that a major part of the fourth aperture is positioned in the second filter part, all parts of the apertures being separated along the longitudinal extension.

5. The waveguide E-plane filter component according to claim 4, wherein the second aperture comprises a second aperture second edge, the third aperture comprises a third aperture first edge and a third aperture second edge, and the fourth aperture comprises a fourth aperture first edge, where said edges have a corresponding third imaginary extension, fourth imaginary extension, fifth imaginary extension and sixth imaginary extension running along the corresponding edges, the third extension and the fourth extension facing each other and being separated by a second distance, and the fifth extension and the sixth extension facing each other and being separated by a third distance.

6. The waveguide E-plane filter component according to claim 5, wherein the first imaginary extension, second imaginary extension, third imaginary extension, fourth imaginary extension, fifth imaginary extension, and sixth imaginary extension are perpendicular to the symmetry line.

7. The waveguide E-plane filter component according to claim 4, wherein the first, second, third, and fourth apertures have a rectangular shape.

8. The waveguide E-plane filter component of claim 1, wherein the first aperture and the second aperture are positioned equidistant from the imaginary symmetry line.

9. The waveguide E-plane filter component of claim 1, wherein the first aperture and the second aperture are positioned in an alternating manner along the imaginary symmetry line.

10. The waveguide E-plane filter component of claim 9, wherein the first aperture and the second aperture are positioned in a non-overlapping manner along the imaginary symmetry line.

11. The waveguide E-plane filter component of claim 9, wherein the first aperture and the second aperture are positioned in an overlapping manner along the imaginary symmetry line.

12. The waveguide E-plane filter component of claim 1, wherein the imaginary symmetry line is linear.

13. The waveguide E-plane filter component of claim 1, wherein a shape of each of the first aperture and the second aperture is rectangular.

14. The waveguide E-plane filter component of claim 1, wherein a shape of the filter part is rectangular.

* * * * *

UNITED STATES PATENT AND TRADEMARK OFFICE

CERTIFICATE OF CORRECTION

PATENT NO. : 9,019,047 B2
APPLICATION NO. : 14/113372
DATED : April 28, 2015
INVENTOR(S) : Kozakowski et al.

It is certified that error appears in the above-identified patent and that said Letters Patent is hereby corrected as shown below:

In the specification

In Column 5, Line 30, delete “foil 10” and insert -- foil 10’ --, therefor.

In Column 5, Line 37, delete “edge 17b” and insert -- edge 17b’ --, therefor.

In Column 5, Line 40, delete “edges 17b,” and insert -- edges 17b’, --, therefor.

In Column 5, Line 59, delete “foil 10,” and insert -- foil 10’, --, therefor.

In Column 6, Line 19, delete “filter 1” and insert -- filter 1’ --, therefor.

In Column 6, Line 34, delete “filter 1.” and insert -- filter 1’. --, therefor.

In Column 6, Line 37, delete “if any” and insert -- if any, --, therefor.

Signed and Sealed this
Sixth Day of October, 2015

Michelle K. Lee

Michelle K. Lee
*Director of the United States Patent and Trademark Office*